US008686821B2

(12) United States Patent
Chang et al.

(10) Patent No.: US 8,686,821 B2
(45) Date of Patent: Apr. 1, 2014

(54) INDUCTOR STRUCTURE

(75) Inventors: Yung-Chung Chang, Yunlin County (TW); Meng-Sheng Chen, Kaohsiung (TW); Chang-Chih Liu, Taichung (TW); Li-Chi Chang, Taichung (TW); Cheng-Hua Tsai, New Taipei (TW)

(73) Assignee: Industrial Technology Research Institute, Hsinchu (TW)

( * ) Notice: Subject to any disclaimer, the term of this patent is extended or adjusted under 35 U.S.C. 154(b) by 0 days.

(21) Appl. No.: 13/526,534

(22) Filed: Jun. 19, 2012

(65) Prior Publication Data

US 2013/0187743 A1 Jul. 25, 2013

(30) Foreign Application Priority Data

Jan. 19, 2012 (TW) ..... 101102221 A

(51) Int. Cl.
*H01F 21/02* (2006.01)
*H01F 27/28* (2006.01)

(52) U.S. Cl.
USPC ..... 336/147; 336/180; 336/223

(58) Field of Classification Search
USPC ..... 336/200, 223, 145, 182, 220, 170
See application file for complete search history.

(56) References Cited

U.S. PATENT DOCUMENTS

| | | | | |
|---|---|---|---|---|
| 6,008,102 | A | 12/1999 | Alford et al. | |
| 6,031,445 | A * | 2/2000 | Marty et al. | 336/200 |
| 6,148,500 | A * | 11/2000 | Krone et al. | 29/602.1 |
| 6,291,872 | B1 | 9/2001 | Wang et al. | |
| 6,667,536 | B2 * | 12/2003 | Chaudhry et al. | 257/531 |
| 6,990,729 | B2 | 1/2006 | Pleskach et al. | |
| 7,088,215 | B1 | 8/2006 | Winter et al. | |
| 7,170,384 | B2 | 1/2007 | Kim et al. | |
| 7,388,462 | B2 * | 6/2008 | Ahn et al. | 336/200 |
| 2002/0105406 | A1 * | 8/2002 | Liu et al. | 336/200 |

FOREIGN PATENT DOCUMENTS

| | | |
|---|---|---|
| CN | 102097429 | 6/2011 |
| JP | 2009-277842 | 11/2009 |
| TW | 200739869 | 10/2007 |

OTHER PUBLICATIONS

Takana Kaho, et al., "Miniaturized Multilayer Inductors on GaAs Three-dimensional MMIC", Korea-Japan Microwave Conference, Nov. 15-16, 2007, pp. 149-152.

Sunderarajan S. Mohan, et al., "Simple Accurate Expressions for Planar Spiral Inductances", IEEE Journal of Solid-State Circuits, vol. 34, No. 10, Oct. 1999, pp. 1419-1424.

Belinda Piernas, et al., "High-Q Factor Three-Dimensional Inductors", IEEE Transactions on Microwave Theory and Techniques, vol. 50, No. 8, Aug. 2002, pp. 1942-1949.

C. S. Lin, et al., "A Deep Submicrometer CMOS Process Compatible High-Q Air-Gap Solenoid Inductor With Laterally Laid Structure", IEEE Electron Device Letters, vol. 26, No. 3, Mar. 2005, pp. 160-162.

J. Carlson, et al., "A Stackable Silicon Interposer with Integrated Through-Wafer Inductors", Electronic Components and Technology Conference, May 29-Jun. 1, 2007, pp. 1235-1238.

"Office Action of Taiwan Counterpart Application", issued on Dec. 30, 2013, p. 1-p. 5, in which the listed reference was cited.

* cited by examiner

*Primary Examiner* — Alexander Talpalatski
*Assistant Examiner* — Mangtin Lian
(74) *Attorney, Agent, or Firm* — Jianq Chyun IP Office

(57) ABSTRACT

An inductor structure including a plurality of solenoids and at least one connecting line is provided. One of the solenoids serves as a core, and the remaining solenoids are sequentially wound around the core solenoid. Axes of the solenoids are substantially directed to the same direction. Each connecting line is correspondingly connected between ends of two adjacent solenoids to serially connect the solenoids.

4 Claims, 8 Drawing Sheets

INDUCTOR STRUCTURE

CROSS-REFERENCE TO RELATED APPLICATION

This application claims the priority benefit of Taiwan application serial no. 101102221, filed on Jan. 19, 2012. The entirety of the above-mentioned patent application is hereby incorporated by reference herein and made a part of this specification.

TECHNICAL FIELD

The disclosure relates to a three-dimensional (3D) inductor structure.

BACKGROUND

Inductors can store/release energy under the condition of electromagnetic conversion, and the inductors may be used as elements for stabilizing current. In addition, in integrated circuits (IC), the inductors play an important role but are challenging elements. A variety of methods and techniques have been proposed for integrating inductors with IC processes. In some conventional 3D inductor devices, the main structure is constructed by plated through holes (PTHs) and surface metal circuits, and solenoid inductors are formed in a substrate.

SUMMARY

An inductor structure that includes a plurality of solenoids and at least one connecting line is introduced herein. One of the solenoids serves as a core, and the remaining solenoids are sequentially wound around the core solenoid. Axes of the solenoids are substantially directed to the same direction. Each connecting line is correspondingly connected between ends of two adjacent solenoids to serially connect the solenoids.

Several exemplary embodiments accompanied with figures are described in detail below to further describe the disclosure in details.

BRIEF DESCRIPTION OF THE DRAWINGS

The accompanying drawings are included to provide further understanding, and are incorporated in and constitute a part of this specification. The drawings illustrate exemplary embodiments and, together with the description, serve to explain the principles of the disclosure.

DESCRIPTION OF EMBODIMENTS

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawings.

In the embodiments provided hereinafter, an inductor structure configured in a printed circuit board (PCB) is applied to explain the technical scheme of the disclosure. As a matter of fact, the inductor structure described herein is applicable to various devices or substrates with a multi-layer circuit structure, such as a ceramic circuit board, a chip, or an interposer.

Figure 1A:
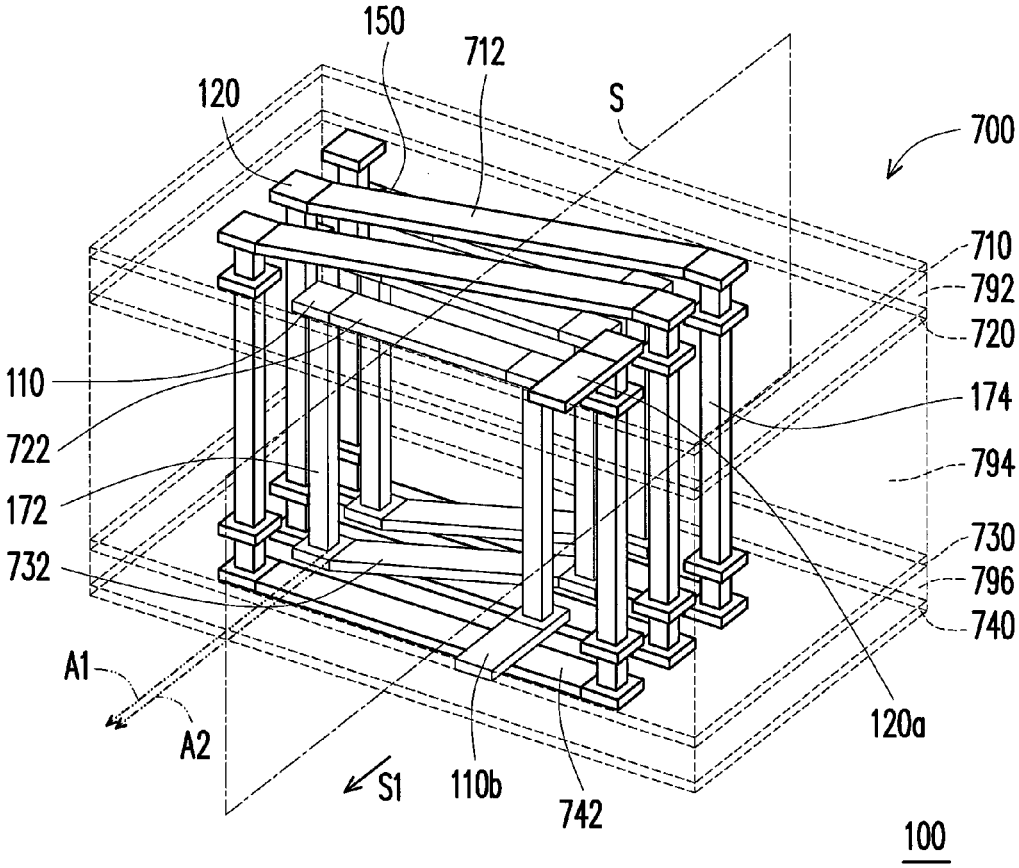
FIG. 1A illustrates an inductor structure according to an exemplary embodiment of the disclosure.
Figure 1B:
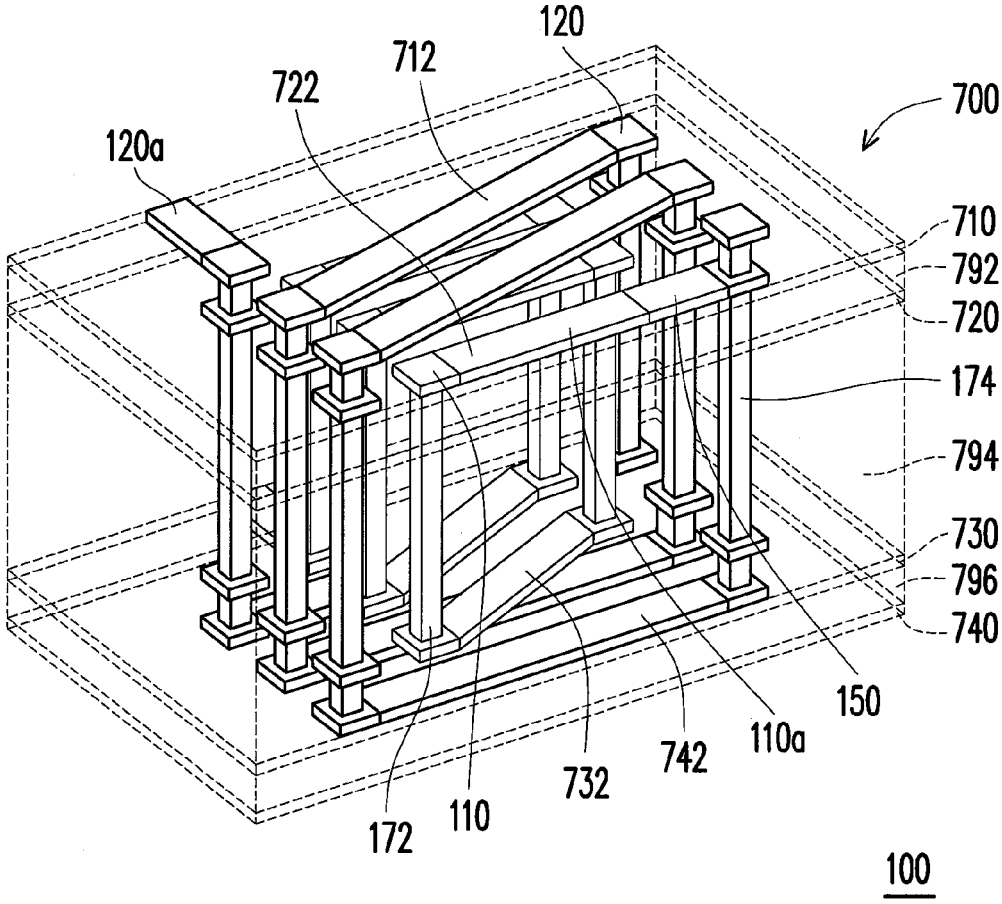
FIG. 1B is a schematic view illustrating the inductor structure depicted in FIG. 1A at another viewing angle.
Figure 1C:
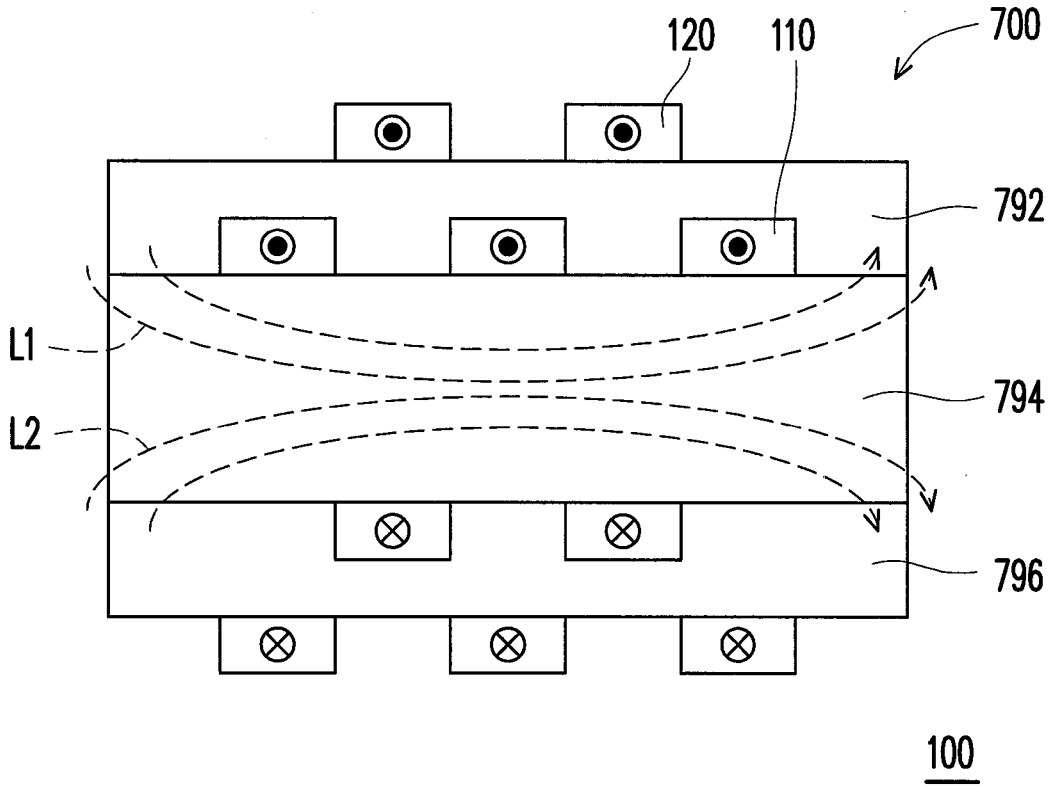
FIG. 1C is a cross-sectional view illustrating the inductor structure depicted in FIG. 1A taken along a section S.

FIG. 1A illustrates an inductor structure according to an exemplary embodiment of the disclosure. FIG. 1B is a schematic view illustrating the inductor structure depicted in FIG. 1A at another viewing angle. FIG. 1C is a cross-sectional view illustrating the inductor structure depicted in FIG. 1A taken along a section S.

As shown in FIG. 1A to FIG. 1C, the inductor structure 100 is configured in a four-layer circuit board 700 that includes a first circuit layer 710, a second circuit layer 720, a third circuit layer 730, a fourth circuit layer 740, a first dielectric layer 792 between the circuit layers 710 and 720, a second dielectric layer 794 between the circuit layers 720 and 730, and a third dielectric layer 796 between the circuit layers 730 and 740. In the present embodiment, the inductor structure 100 includes a first solenoid 110 and a second solenoid 120. The second solenoid 120 is wound around the first solenoid 110. An axis A1 of the first solenoid 110 and an axis A2 of the second solenoid 120 substantially extend toward the same direction and are parallel to a planar direction S1 of any layer in the four-layer circuit board 700. That is to say, the first solenoid 110 and the second solenoid 120 have the same current direction, so as to magnetic lines in the same direction after an electric current is switched on. For instance, as depicted in FIG. 1C, the magnetic line L1 of the first solenoid 110 and the magnetic line L2 of the second solenoid 120 have the same direction. In addition to the inductance generated by the first and second solenoids 110 and 120, mutual inductance is also generated between the first and second solenoids 110 and 120, and thereby the inductor structure 100 can have the increased inductance value per unit area. According to the present embodiment, the axis A1 of the first solenoid 110 and the axis A2 of the second solenoid 120 can be selectively coincided with each other, such that the first and second solenoids 110 and 120 are symmetrical. This is conducive to improvement of mutual inductance.

To be more specific, the first solenoid 110 includes a plurality of second conductive lines 722 located in the second circuit layer 720, a plurality of third conductive lines 732 located in the third circuit layer 730, and a plurality of first conductive vias 172 passing through the second dielectric layer 794. The first conductive vias 172 are adapted for connecting corresponding second and third conductive lines 722 and 732, so as to form the first solenoid 110. According to the present embodiment, the second solenoid 120 includes a plurality of first conductive lines 712 located in the first circuit layer 710, a plurality of fourth conductive lines 742 located in the fourth circuit layer 740, and a plurality of second conductive vias 174 passing through the first, second, and third dielectric layers 792, 794, and 796. The second conductive vias 174 are adapted for connecting corresponding first and fourth conductive lines 712 and 742, so as to form the second solenoid 120. The inductor structure 100 further includes a connecting line 150 that is exemplarily located in the second circuit layer 720 for connecting one end 110*a* of the first solenoid 110 to the second solenoid 120, such that the first solenoid 110 and the second solenoid 120 are serially connected to each other. Thereby, the current input from one end 120*a* of the second solenoid 120 may flow through the connecting line 150 along the winding direction of the second solenoid 120 and enter the first solenoid 110, and the current may then be output from the other end 110*b* of the first solenoid 110 along the same winding direction.

As described in the present embodiment, the space within the second solenoid 120 is effectively utilized because the first solenoid 110 is configured in the inner layers (the second circuit layer 720, the third circuit layer 730, and the second dielectric layer 794) of the circuit board 700. Note that the mutual inductance may be generated between the first solenoid 110 and the second solenoid 120. Therefore, the inductor structure 100 not only can be characterized by favorable space utilization rate but also can have the improved inductance value per unit area due to the mutual inductance between the solenoids.

From another perspective, in the present embodiment, the upper trace and the lower trace in the first solenoid 110 or the second solenoid 120 have opposite current directions. Hence, in order to prevent the inductance value and the Q value from being lowered down as the upper and lower traces are overly close, the material thickness (e.g., the thickness of the second dielectric layer 794) between the upper and lower traces can be adjusted. For instance, according to the standard substrate circuit manufacturing process, the line width and the line pitch of circuits are usually 100 um or more. Accordingly, it is recommended that the material thickness (e.g., the thickness of the second dielectric layer 794) between the upper and lower traces be 200 um or more. Besides, even though the first and second solenoids 110 and 120 have the same current direction, the overly thin material leads to an increase in the capacitance and the reduction of self-oscillation frequency. Hence, it is recommended that the material thickness (e.g., the thickness of the first dielectric layer 794 or the thickness of the third dielectric layer 796) between the first and second solenoids 110 and 120 be 100 um or more. As a result, the total thickness of the four-layer circuit board 700 shown in FIG. 1C is greater than 400 um. Certainly, if the line width and the line pitch are less than 100 um, the corresponding recommended material thickness (e.g., the total thickness of each dielectric layer or the circuit board) may be further reduced.

Simulation is performed to evaluate the performance of the inductor structure 100 in the present embodiment. In the simulation, the four-layer circuit board 700 has the following characteristics: the dielectric constants (DK) of the first, second, and third dielectric layers 792, 794, and 796 are 3.3, for instance, and the dissipation factors (DF) thereof are 0.004, for instance; the thickness of the first dielectric layer 792 and the thickness of the third dielectric layer 796 are respectively 91 um, for instance, and the thickness of the second dielectric layer 794 is 600 um, for instance. Note that the inductance value of the conventional inductor structure (only having the structure similar to the second solenoid 120) is approximately 6.73 nH, while the inductance value of the inductor structure 100 in the present embodiment may reach approximately 13.4 nH. That is to say, on the same conditions (especially when the same circuit area is given), the inductance value of the inductor structure 100 in the present embodiment approximately doubles the inductance value of the conventional inductor structure.

As to the manufacturing process, the inductor structure 100 described in the present embodiment does not require the any-layer-via-stacked-up manufacturing process, and the process of fabricating the inductor structure 100 in the four-layer circuit board 700 is compatible with the existing process of fabricating the printed circuit board. In particular, the first solenoid 110 is formed when the core layer (i.e., the second dielectric layer 794) of the four-layer circuit board 700, the third circuit layer 730, and the second circuit layer 720 are formed. Here, the first conductive vias 172 are PTHs formed in the second dielectric layer 794 through laser drilling or mechanical drilling, for instance. Besides, the second conductive lines 722, the third conductive lines 732, and the connecting line 150 are also formed during the fabrication of the second and third circuit layers 720 and 730.

The first dielectric layer 792 and the third dielectric layer 796 are respectively formed at the upper side and the lower side of the second dielectric layer 794 through lamination, for instance, and PTHs passing through the first, second, and third dielectric layers 792, 794, and 796 are formed through laser drilling or mechanical drilling together with fabrication of the first and fourth circuit layers 710 and 740, for instance. Here, the PTHs serve as the second conductive vias 174. In addition, the first and fourth conductive lines 712 and 742 are formed at the same time when the first and fourth circuit layers 710 and 740 are formed. Thereby, the second solenoid 120 wound around the first solenoid 110 may be formed.

Based on the above, the any-layer-via-stacked-up manufacturing process is not required in the present embodiment, and the 3D inductor structure 100 can still be formed in the four-layer circuit board 700. This is conducive to reduction of the manufacturing costs.

Figure 2A:
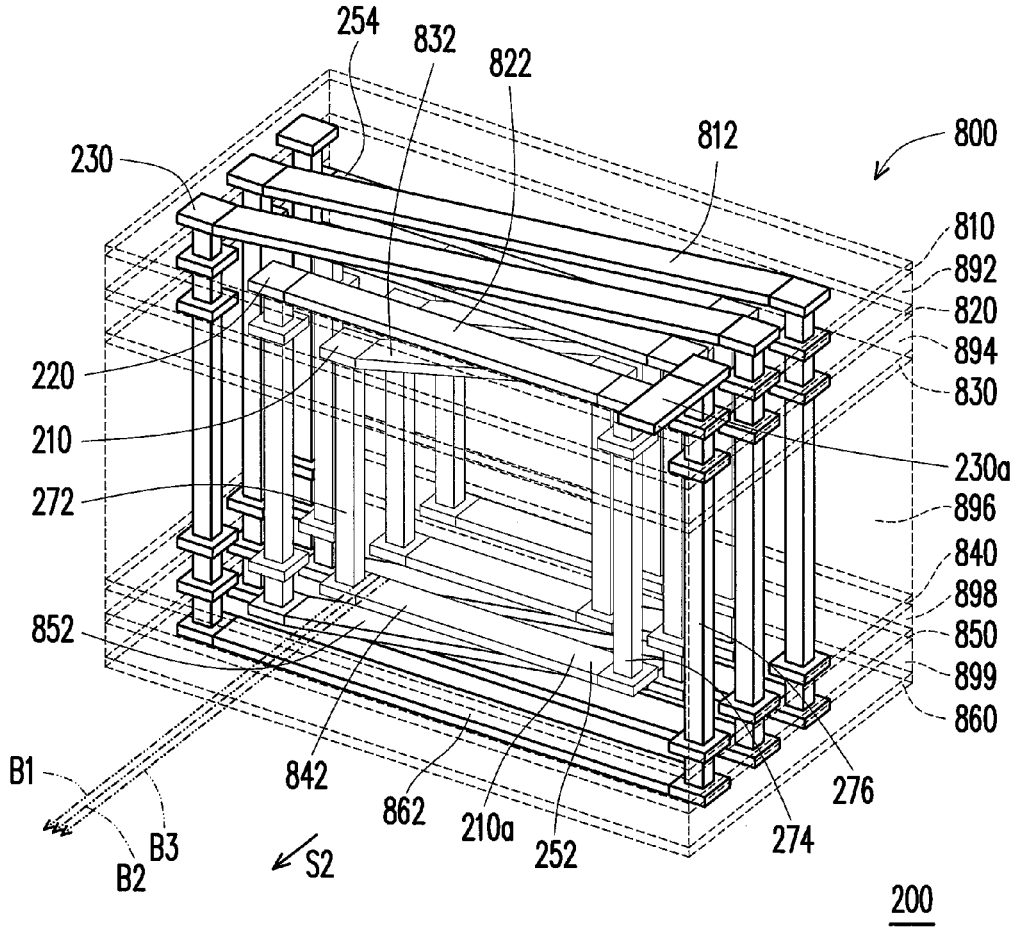
FIG. 2A illustrates an inductor structure according to another exemplary embodiment of the disclosure.
Figure 2B:
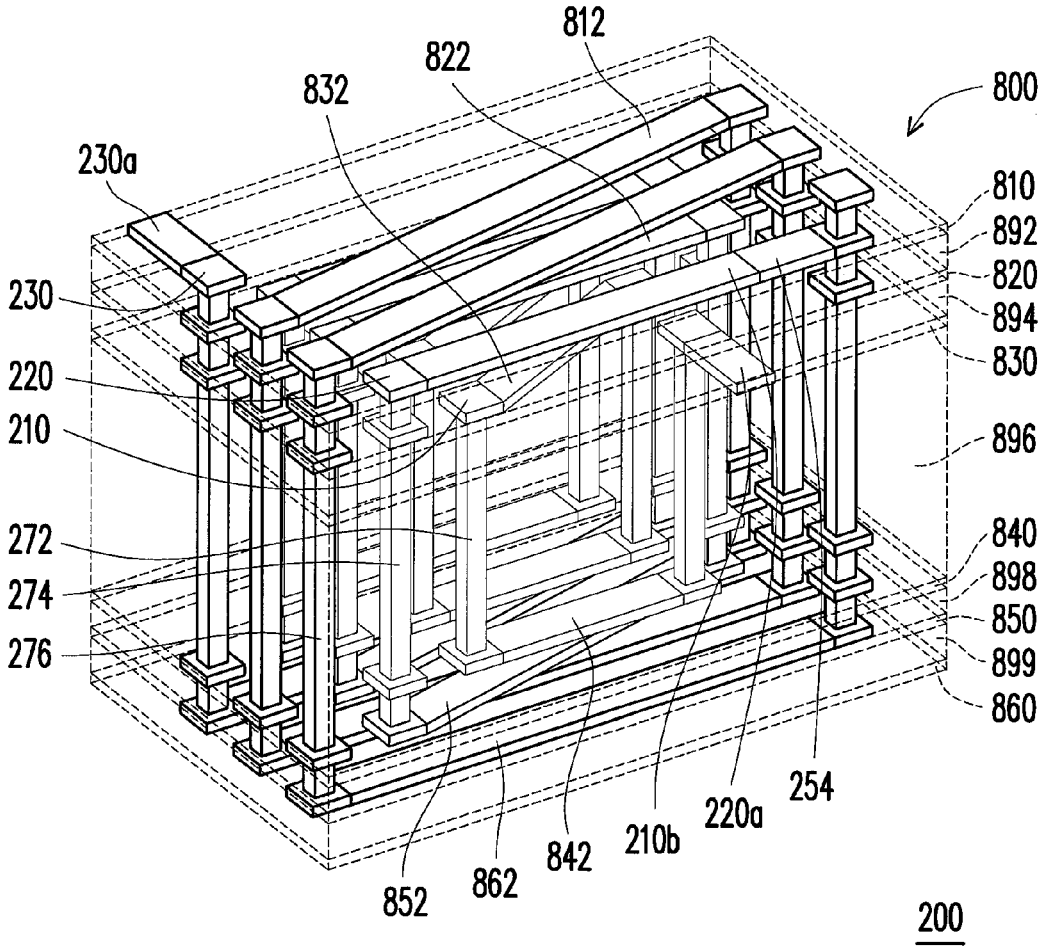
FIG. 2B is a schematic view illustrating the inductor structure depicted in FIG. 2A at another viewing angle.

FIG. 2A illustrates an inductor structure according to another exemplary embodiment of the disclosure. FIG. 2B is a schematic view illustrating the inductor structure depicted in FIG. 2A at another viewing angle.

As indicated in FIG. 2A and FIG. 2B, the inductor structure 200 described in the present embodiment is similar to the inductor structure 100 described in the previous embodiment. The main difference between the inductor structure 100 and the inductor structure 200 lies in that the inductor structure 200 of the present embodiment is configured in a six-layer circuit board 800 and includes a first solenoid 210, a second solenoid 220, and a third solenoid 230. The second solenoid 220 is wound around the first solenoid 210, and the third solenoid 230 is wound around the second solenoid 220. An axis B1 of the first solenoid 210, an axis B2 of the second solenoid 220, and an axis B3 of the third solenoid 230 approximately extend toward the same direction and are parallel to a planar direction S2 of any layer in the six-layer circuit board 800. That is to say, the first solenoid 210, the second solenoid 220, and the third solenoid 230 have the same current direction, so as to form magnetic lines in the same direction after an electric current is switched on.

To be more specific, the six-layer circuit board 800 of the present embodiment includes a first circuit layer 810, a second circuit layer 820, a third circuit layer 830, a fourth circuit layer 840, a fifth circuit layer 850, a sixth circuit layer 860, a first dielectric layer 892 between the circuit layers 810 and 820, a second dielectric layer 894 between the circuit layers 820 and 830, a third dielectric layer 896 between the circuit layers 830 and 840, a fourth dielectric layer 898 between the circuit layers 840 and 850, and a fifth dielectric layer 899 between the circuit layers 850 and 860.

The first solenoid 210 includes a plurality of third conductive lines 832 located in the third circuit layer 830, a plurality of fourth conductive lines 842 located in the fourth circuit layer 840, and a plurality of first conductive vias 272 passing through the third dielectric layer 896. The first conductive vias 272 are adapted for connecting corresponding third and fourth conductive lines 832 and 842, so as to form the first solenoid 210.

The second solenoid 220 includes a plurality of second conductive lines 822 located in the second circuit layer 820, a plurality of fifth conductive lines 852 located in the fifth circuit layer 850, and a plurality of second conductive vias 274 passing through the second, third, and fourth dielectric layers 894, 896, and 898. The second conductive vias 274 are adapted for connecting corresponding second and fifth conductive lines 822 and 852, so as to form the second solenoid 220. The inductor structure 200 further includes a first connecting line 252 located in the fourth circuit layer 840 for connecting one end 210*a* of the first solenoid 210 to the second solenoid 220, such that the first solenoid 210 and the second solenoid 220 are serially connected to each other.

The third solenoid 230 includes a plurality of first conductive lines 812 located in the first circuit layer 810, a plurality of sixth conductive lines 862 located in the sixth circuit layer 860, and a plurality of third conductive vias 276 passing through the first, second, third, fourth, and fifth dielectric layers 892, 894, 896, 898, and 899. The third conductive vias 276 are adapted for connecting corresponding first and sixth conductive lines 812 and 862, so as to form the third solenoid 230. The inductor structure 200 further includes a second connecting line 254 located in the second circuit layer 820 for connecting one end 220*a* of the second solenoid 220 to the third solenoid 230, such that the first solenoid 210, the second solenoid 220, and the third solenoid 230 are serially connected to one other through the first connecting line 252 and the second connecting line 254.

Thereby, the current input from one end 230*a* of the third solenoid 230 may flow through the second connecting line 254 along the winding direction of the third solenoid 230 and enter the second solenoid 220, flow through the second solenoid 220 and the first connecting line 252 along the same winding direction, and may then be output from the other end 210*b* of the first solenoid 210 along the same winding direction, for instance.

Similarly, as to the manufacturing process, the inductor structure 200 described in the present embodiment can be formed in no need of performing the any-layer-via-stacked-up manufacturing process, and the process of sequentially fabricating the first solenoid 210, the first connecting line 242, the second solenoid 220, the second connecting line 254, and the third solenoid 230 in the six-layer circuit board 800 is compatible with the existing process of fabricating the printed circuit board according to the present embodiment. Detailed steps in the manufacturing process can be referred to as those provided in the previous embodiment, and no other descriptions are provided hereinafter.

Based on the above, the any-layer-via-stacked-up manufacturing process is not required in the present embodiment, and the 3D inductor structure 200 can still be formed in the six-layer circuit board 800. This is conducive to reduction of the manufacturing costs.

Certainly, in the inductor structure 200 described in the present embodiment or the inductor structure 100 described in the previous embodiment, the conductive lines in each circuit layer may be serially connected through stacked vias or conductive elements with similar functions to form the solenoids, and stacked vias and conductive elements may be formed in the circuit board through performing the any-layer-via-stacked-up manufacturing process or any other appropriate process.

In both the present embodiment and the previous embodiment, the inner space of the multi-layer circuit board is effectively utilized because a plurality of serially connected solenoids (among which the mutual inductance is generated) are formed in the same space, and thereby the inductance value per unit area in the multi-layer circuit board can be increased.

Note that the number of the solenoids described in the previous embodiments should not be construed as a limitation to the scope of the disclosure. In fact, the number and the position of the solenoids may be determined by the number of layers of the circuit board and the actual requirements. Generally, given that the multi-layer circuit board includes N circuit layers and a plurality of dielectric layers located among the circuit layers, the number of the solenoids may be M, and M is greater than 1 and smaller than or substantially equal to N/2. As shown in the previous two embodiments, when the multi-layer circuit board is a four-layer circuit board and has four circuit layers, the number of the solenoids is 2 at most. Besides, when the multi-layer circuit board is a six-layer circuit board and has six circuit layers, the number of the solenoids is 3 or less than 3. At this time, the circuit layers are defined as the first circuit layer to the $N^{th}$ circuit layer sequentially arranged along a direction, and the solenoids are defined as the first solenoid to the $M^{th}$ solenoid sequentially arranged inside out. Here, each of the solenoids may be represented as below.

An $(i)^{th}$ solenoid comprising a plurality of $(a_i)^{th}$ conductive lines located in an $(a_i)^{th}$ circuit layer of the circuit layers; a plurality of $(b_i)^{th}$ conductive lines located in a $(b_i)^{th}$ circuit layer of the circuit layers; and a plurality of $(i)^{th}$ conductive vias. Each of the $(i)^{th}$ conductive vias passes through all of the dielectric layers among the $(a_i)^{th}$ circuit layer and the $(b_i)^{th}$ circuit layer and connects the corresponding $(a_i)^{th}$ conductive lines and the corresponding $(b_i)^{th}$ conductive lines to form the $(i)^{th}$ solenoid, wherein i is an integer ranging from 1 to M, $a_i$ and $b_i$ are integers ranging from 1 to N, $a_i<b_i$, $a_1>a_2 \ldots >a_{M-1}>a_M$, and $b_1<b_2 \ldots <b_{M-1}<b_M$.

The aforesaid principle is applicable not only to the inductor structure including two or three solenoids but also to the inductor structure having more solenoids.

Moreover, the innermost solenoid may be selectively configured on the core layer of the multi-layer circuit board in the disclosure, and the circuit layers located at two opposite sides of the core layer can act as the conductive lines of the innermost solenoid. Additionally, PTHs passing through the core layer can serve as the conductive vias. That is to say, when i=1, the dielectric layer located between the $a_1$ circuit layer and the $b_1$ circuit layer is the core layer of the multi-layer circuit board.

The directions of axes of the solenoids in the inductor structure can also be modified and should not be limited in the disclosure, e.g., the directions of axes of the solenoids may be perpendicular to a planar direction of the multi-layer circuit board. Such an inductor structure is elaborated in the following embodiment.

Figure 3A:
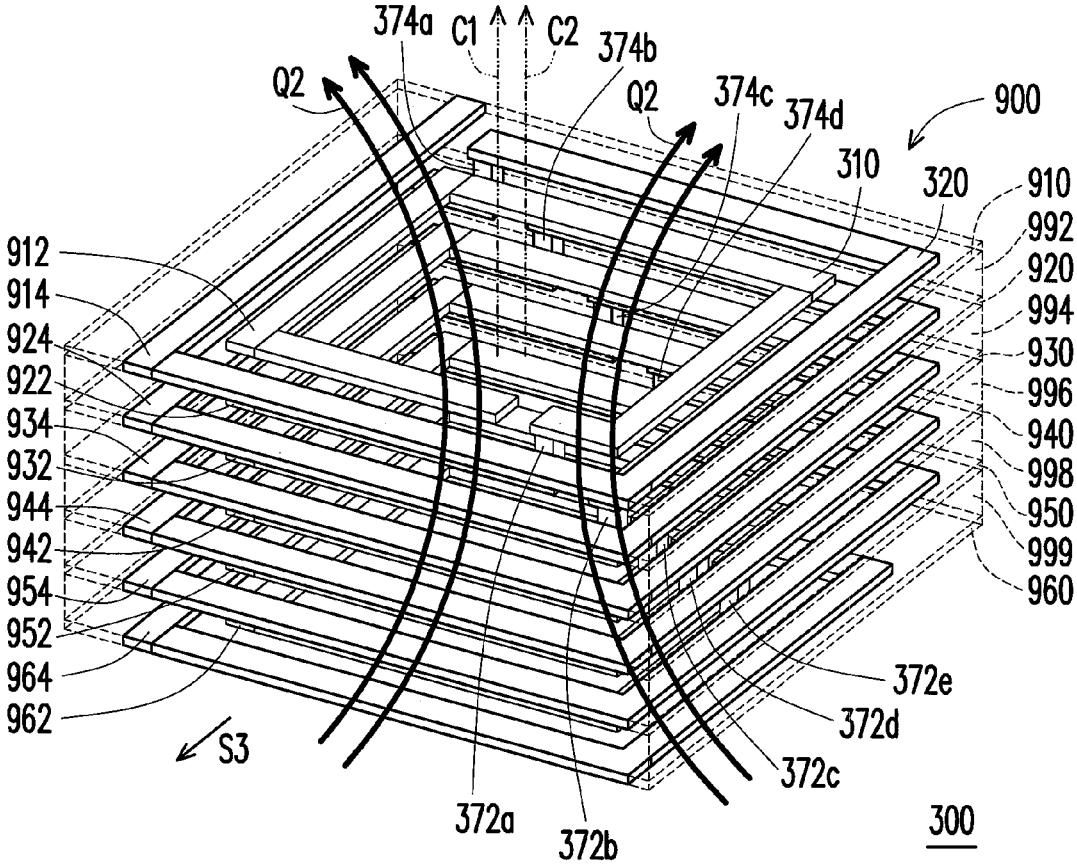
FIG. 3A illustrates an inductor structure according to another exemplary embodiment of the disclosure.
Figure 3B:
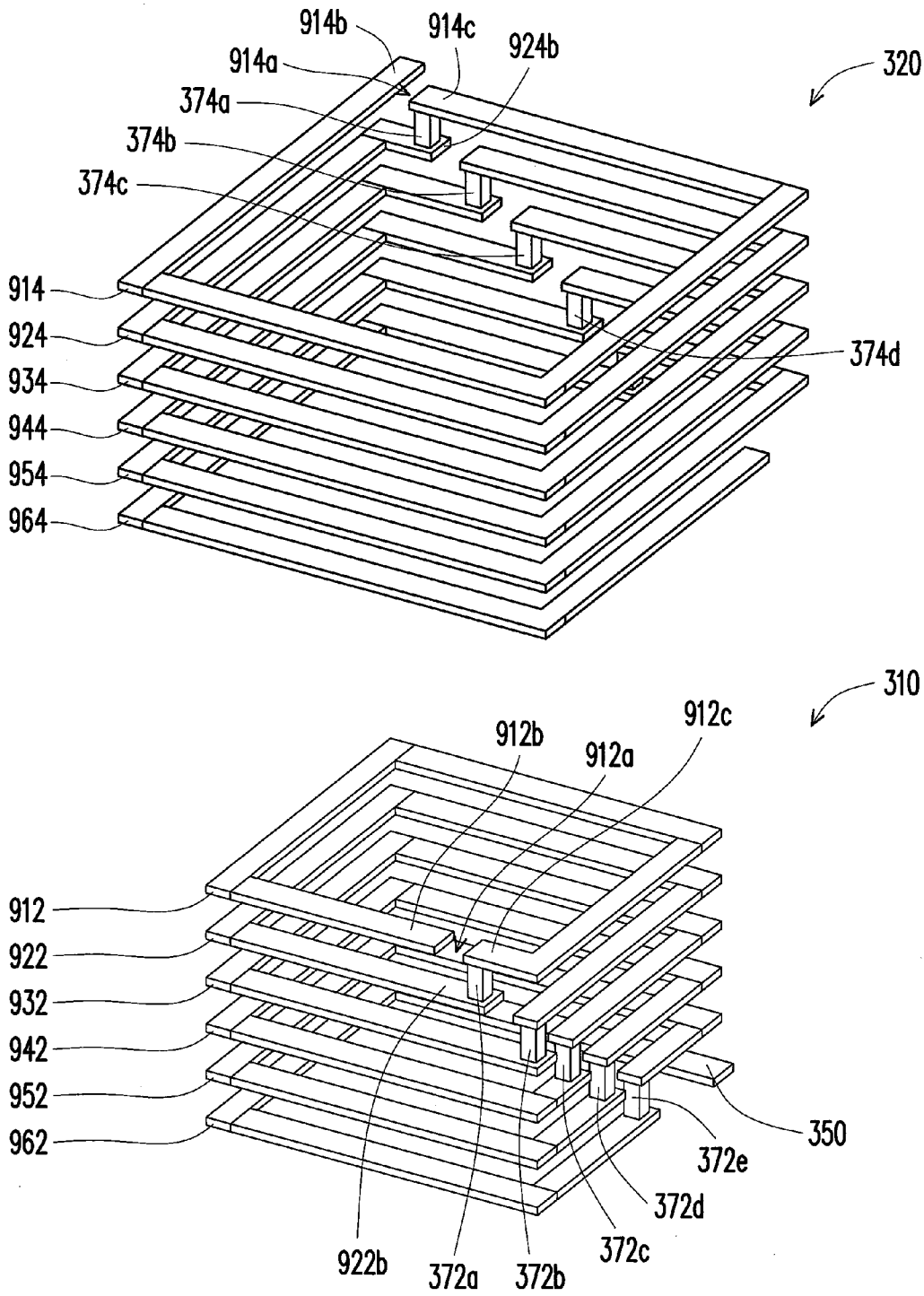
FIG. 3B is an exploded view illustrating the inductor structure depicted in FIG. 3A.
Figure 3C:
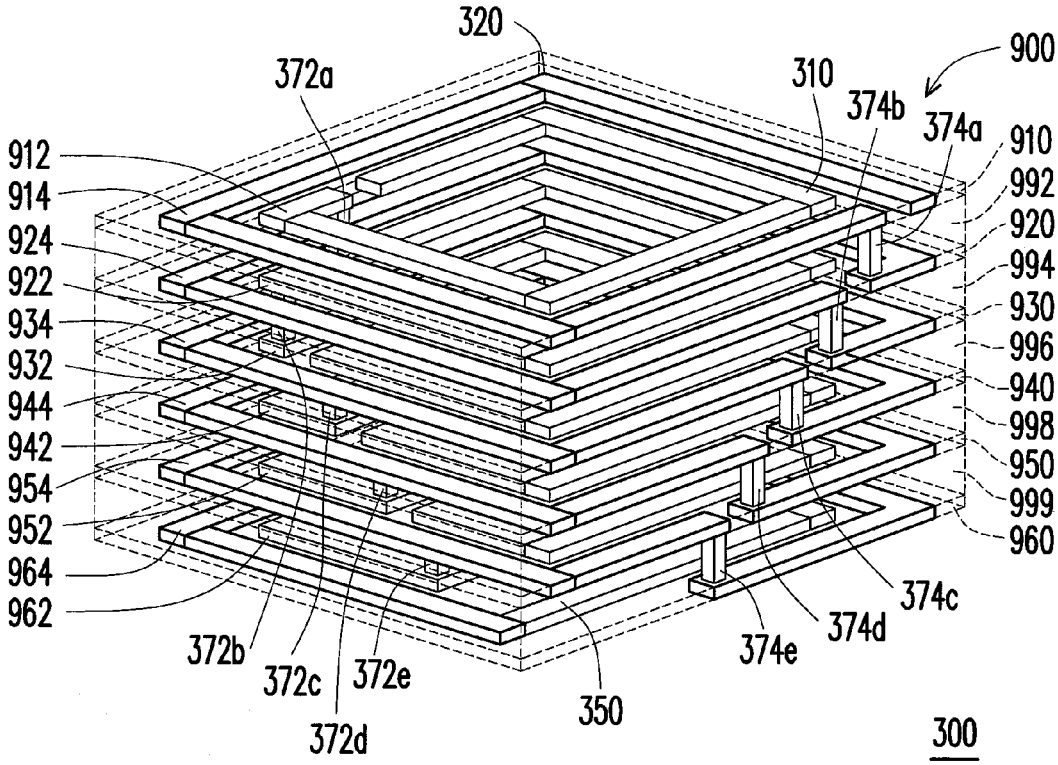
FIG. 3C is a schematic view illustrating the inductor structure depicted in FIG. 3A at another viewing angle.

FIG. 3A illustrates an inductor structure according to another exemplary embodiment of the disclosure. FIG. 3B is an exploded view illustrating the inductor structure depicted in FIG. 3A for elaborating the structure of each solenoid. FIG. 3C is a schematic view illustrating the inductor structure depicted in FIG. 3A at another viewing angle.

As indicated in FIG. 3A to FIG. 3C, the inductor structure 300 of the present embodiment is configured in the multi-layer circuit board 900 and includes a first solenoid 310 and a second solenoid 320. The second solenoid 320 is wound around the first solenoid 310.

An axis C1 of the first solenoid 310 and an axis C2 of the second solenoid 320 substantially extend toward the same direction and are substantially perpendicular to a planar direction S3 of any layer in the multi-layer circuit board 900. In the present embodiment, the first solenoid 310 and the second solenoid 320 have the same current direction, so as to form magnetic lines Q1 and Q2 in the same direction after an electric current is switched on.

In particular, the first solenoid 310 includes a plurality of conductive lines 912~962 formed in the circuit layers 910~960 of the multi-layer circuit board 900, and a plurality of conductive vias 372*a*, 372*b*, 372*c*, 372*d*, and 372*e* are formed in the dielectric layers 992, 994, 996, 998, and 999 among the circuit layers 910~960 for serially connecting the conductive lines 912~962. The conductive via 372*a* is adapted for connecting the conductive lines 912 and 922, the conductive via 372*b* is adapted for connecting the conductive lines 922 and 932, the conductive via 372*c* is adapted for connecting the conductive lines 932 and 942, the conductive via 372*d* is adapted for connecting the conductive lines 942 and 952, and the conductive via 372*e* is adapted for connecting the conductive lines 952 and 962. Similarly, the second solenoid 320 includes a plurality of conductive lines 914~964 formed in the circuit layers 910~960 of the multi-layer circuit board 900, and a plurality of conductive vias 374*a*, 372*b*, 372*c*, 372*d*, and 372*e* are formed in the dielectric layers 992, 994, 996, 998, and 999 among the circuit layers 910~960 for serially connecting the conductive lines 914~964. In particular, the conductive via 374*a* is adapted for connecting the conductive lines 914 and 924, the conductive via 374*b* is adapted for connecting the conductive lines 924 and 934, the conductive via 374*c* is adapted for connecting the conductive lines 934 and 944, the conductive via 374*d* is adapted for connecting the conductive lines 944 and 954, and the conductive via 374*e* is adapted for connecting the conductive lines 954 and 964. The connecting line 350 is located in the circuit layer 960 for connecting the conductive line 962 of the first solenoid 310 and the conductive line 964 of the second solenoid 320.

In the present embodiment, each of the conductive lines 912~962 or 914~964 is for example a rectangular hoop provided with a gap, for instance. As illustrated in FIG. 3B, the conductive line 912 has the gap 912*a*, and the conductive line 914 has the gap 914*a*. Each of the conductive lines 912~962 or 914~964 has a first end and a second end located at two sides of the gap. As illustrated in FIG. 3B, the conductive line 912 has the first end 912*b* and the second end 912*c* located at two sides of the gap 912*a*, and the conductive line 914 has the first end 914*b* and the second end 914*c* located at two sides of the gap 914*a*. Besides, in any two adjacent conductive lines, the second end of the upper conductive line is connected to the first end of the lower conductive line through the corresponding conductive via. As illustrated in FIG. 3B, the second end 912*c* of the conductive line 912 is connected to the first end 922*b* of the lower conductive line 922 through the corresponding conductive via 372*a*, and the second end 914*c* of the conductive line 914 is connected to the first end 924*b* of the lower conductive line 924 through the corresponding conductive via 374*a*. Thereby, the conductive lines 912~962, 914~964 and the corresponding conductive vias 372*a*~372*e*, 374*a*~374*e* may form the first and second solenoids 310 and 320.

For instance, the current input from the first end 912*b* of the conductive line 912 of the first solenoid 310 may sequentially flow through the conductive lines 912~962 and the conductive vias 372*a*~372*e* among the conductive lines 912~962 and enter the second solenoid 320 through the connecting line 350, sequentially flow through the conductive lines 914~964 and the conductive vias 374*a*~374*e* among the conductive lines 914~964 along the same winding direction, and may then be output from the first end 914*b* of the conductive line 914.

As to the manufacturing process, the stacked vias connecting the circuit layers 910~960 may be formed in the dielectric layers 992~999 of the multi-layer circuit board 900 through performing the any-layer-via-stacked-up manufacturing process according to the present embodiment, and the stacked vias can serve as the conductive vias 372*a*~372*e* and 374*a*~374*e*. Besides, since the any-layer-via-stacked-up manufacturing process is applicable, the locations of the conductive vias 372*a*~372*e* and 374*a*~374*e*, the number of the dielectric layers where the conductive vias 372*a*~372*e* and 374*a*~374*e* pass through, or the number of the conducted circuit layers may be changed in the present embodiment. Thus, the structure shown in FIG. 3A to FIG. 3C should not be construed as a limitation to the disclosure. Certainly, conductive elements with similar functions may be formed in the circuit board through performing any other appropriate process according to the present embodiment, and thereby the conductive lines in each circuit layer may be serially connected to form the solenoids.

In light of the foregoing, the inductor structure not only can be characterized by the favorable space utilization rate but also can have the improved inductance value per unit area due to the mutual inductance between the solenoids. In addition, the any-layer-via-stacked-up manufacturing process is not required herein, and the 3D inductor structure may still be formed in the multi-layer circuit board through performing certain manufacturing process, which is conducive to reduction of manufacturing costs.

It will be apparent to those skilled in the art that various modifications and variations can be made to the disclosed embodiments. It is intended that the specification and examples be considered as exemplary only, with a true scope of the disclosure being indicated by the following claims and their equivalents.

What is claimed is:

1. An inductor structure comprising:

a plurality of solenoids, one of the solenoids serving as a core, the remaining solenoids being sequentially wound around the core solenoid, axes of the plurality of solenoids being substantially directed to a same direction; and at least one connecting line, each of the at least one connecting line being correspondingly connected between ends of two adjacent solenoids to serially connect the plurality of solenoids, the inductor structure being constructed in a multi-layer circuit board, wherein the axes of the solenoids are parallel to a planar direction of the multi-layer circuit board, wherein the multi-layer circuit board comprises N circuit layers and a plurality of dielectric layers located among the circuit layers, the number of the solenoids is M, and M is greater than 1 and smaller than or substantially equal to N/2, and wherein the circuit layers are sequentially arranged from a first circuit layer to an $N^{th}$ circuit layer along a direction, the solenoids are arranged inside out from a first solenoid to an $M^{th}$ solenoid, and each of the solenoids is represented as:

an $(i)^{th}$ solenoid comprising:

a plurality of $(a_i)^{th}$ conductive lines located in an $(a_i)^{th}$ circuit layer of the circuit layers;

a plurality of $(b_i)^{th}$ conductive lines located in a $(b_i)^{th}$ circuit layer of the circuit layers; and a plurality of $(i)^{th}$ conductive vias, each of the $(i)^{th}$ conductive vias passing through all of the dielectric layers among the $(a_i)^{th}$ circuit layer and the $(b_i)^{th}$ circuit layer and connecting the corresponding $(a_i)^{th}$ conductive lines and the corresponding $(b_1)^{th}$ conductive lines to form the (i)th solenoid, wherein i is an integer ranging from 1 to M, $a_i$ and $b_i$ are integers ranging from 1 to N, $a_i<b_i$, $a_1>a_2 \ldots >a_M$, and $b_1<b_2 \ldots b_{M-1}<b_M$.

2. The inductor structure as recited in claim 1, wherein the axes of the solenoids are coincided with one another.

3. The inductor structure as recited in claim 1, wherein i=1, and a dielectric layer of the dielectric layers located between the $a_1$ circuit layer and the $b_1$ circuit layer of the circuit layers is a core layer of the multi-layer circuit board.

4. The inductor structure as recited in claim 1, wherein the multi-layer circuit board is a printed circuit board, a ceramic circuit board, a chip, or an interposer.

* * * * *